US009249621B2

(12) United States Patent
Dwarka

(10) Patent No.: US 9,249,621 B2
(45) Date of Patent: Feb. 2, 2016

(54) COIL BRUSH CURTAIN ASSEMBLY

(71) Applicant: Rajiva A. Dwarka, Boston, MA (US)

(72) Inventor: Rajiva A. Dwarka, Boston, MA (US)

( * ) Notice: Subject to any disclaimer, the term of this patent is extended or adjusted under 35 U.S.C. 154(b) by 0 days.

(21) Appl. No.: 13/744,632

(22) Filed: Jan. 18, 2013

(65) Prior Publication Data

US 2013/0220559 A1 Aug. 29, 2013

Related U.S. Application Data

(60) Provisional application No. 61/587,785, filed on Jan. 18, 2012.

(51) Int. Cl.

| | |
|---|---|
| ***E06B 9/58*** | (2006.01) |
| ***E06B 9/42*** | (2006.01) |
| ***E06B 9/17*** | (2006.01) |

(52) U.S. Cl.

CPC ..... *E06B 9/58* (2013.01); *E06B 9/17007* (2013.01); *E06B 9/17076* (2013.01); *E06B 9/42* (2013.01)

(58) Field of Classification Search

USPC ..... 160/41, 11, 84.06, 264, 263, 273.1, 160/271, 262, 272

IPC ... E06B 9/581,2009/588, 2009/407, 2009/1713, E06B 2009/17084, 19/17076

See application file for complete search history.

(56) References Cited

U.S. PATENT DOCUMENTS

| | | | | | |
|---|---|---|---|---|---|
| 1,198,456 | A | * | 9/1916 | Knapp | 160/273.1 |
| 1,725,307 | A | * | 8/1929 | Sembower | 160/264 |
| 1,800,654 | A | * | 4/1931 | Nelson | 160/262 |
| 1,898,686 | A | * | 2/1933 | Rice | 160/263 |
| 2,280,358 | A | | 4/1942 | Tietig | |
| 3,292,685 | A | * | 12/1966 | Clark | 160/26 |
| 3,430,677 | A | | 3/1969 | Pierce | |
| 4,006,770 | A | * | 2/1977 | Ferguson | 160/263 |
| 4,089,361 | A | | 5/1978 | Zeppmeisel | |
| 4,157,108 | A | | 6/1979 | Donofrio | |
| 4,237,956 | A | | 12/1980 | Sivin et al. | |
| 4,357,978 | A | * | 11/1982 | Keller et al. | 160/41 |
| 4,369,829 | A | | 1/1983 | Casiday | |
| 4,467,853 | A | * | 8/1984 | Downey, Jr. | 160/133 |
| 4,478,268 | A | * | 10/1984 | Palmer | 160/310 |
| 4,539,238 | A | | 9/1985 | Markowitz | |
| 4,583,517 | A | | 4/1986 | Hilton et al. | |
| 4,679,406 | A | | 7/1987 | Weiblen | |
| 4,736,785 | A | | 4/1988 | Seuster | |
| 4,776,379 | A | * | 10/1988 | Kraeutler | 160/84.06 |
| 4,800,946 | A | | 1/1989 | Rosenoy | |
| 4,934,437 | A | * | 6/1990 | Kraeutler | 160/84.02 |
| 5,056,579 | A | | 10/1991 | Krafutler | |
| 5,099,905 | A | | 3/1992 | Rigter | |
| 5,141,043 | A | | 8/1992 | Kraeutler | |
| 5,199,479 | A | | 4/1993 | Kraeutler | |
| 5,291,932 | A | | 3/1994 | Kraeutler | |

(Continued)

*Primary Examiner* — David Purol
(74) *Attorney, Agent, or Firm* — Lando & Anastasi LLP

(57) ABSTRACT

According to some embodiments curtain assemblies are provided having fabric curtains with brush edges that are mated to the fabric curtain. The brush edges are configured to extend laterally from the curtain to contact, for example, the side edges of the opening in which the curtain assembly is installed and remain in contact with the side edges during movement of the curtain. The brush edges can be configured to deflect along the plane of the motion of the curtain to maintain the contact between the curtain and the side edges. In some embodiments, the curtain assemblies can include optional side tracks configured to receive the brush edges, for example, to improve the connection between the brush edges and the side edges.

19 Claims, 11 Drawing Sheets

(56) References Cited

U.S. PATENT DOCUMENTS

| | | | |
|---|---|---|---|
| 5,323,831 | A | 6/1994 | Manthei |
| 5,377,738 | A | 1/1995 | Cooper |
| 5,394,926 | A | 3/1995 | Kraeutler |
| 5,477,902 | A | 12/1995 | Kraeutler |
| 5,526,865 | A | 6/1996 | Coenraets |
| 5,791,392 | A | 8/1998 | Fernandez Lopez |
| 6,035,917 | A | 3/2000 | Cohen-Ravid |
| 6,286,579 | B1 | 9/2001 | Gottschalk |
| 6,474,395 | B2 | 11/2002 | Weiss |
| 6,691,761 | B1 | 2/2004 | Alkhoury et al. |
| 6,705,378 | B1 | 3/2004 | Smidt |
| 6,722,416 | B2 | 4/2004 | Varley et al. |
| 7,093,643 | B2 | 8/2006 | Ikle |
| 7,131,481 | B2 | 11/2006 | Varley et al. |
| 7,137,429 | B2 | 11/2006 | Jelic |
| 7,275,581 | B2 | 10/2007 | Coenraets |
| 7,360,575 | B2 | 4/2008 | Weiss |
| 7,416,014 | B2 | 8/2008 | Coenraets |
| 7,748,431 | B2 | 7/2010 | Jansen et al. |
| 7,841,377 | B2 | 11/2010 | Coenraets |
| 8,025,088 | B2 | 9/2011 | Kim |
| 8,113,261 | B2 | 2/2012 | Lin |
| 8,113,265 | B2 | 2/2012 | Hardison, III et al. |
| 8,127,821 | B2 | 3/2012 | Hsu et al. |
| 8,156,992 | B2 | 4/2012 | Diaz et al. |
| 8,186,411 | B2 | 5/2012 | Lin |
| 8,186,412 | B2 | 5/2012 | Lin |
| 8,235,086 | B2 | 8/2012 | Smith |
| 8,291,960 | B2 | 10/2012 | Bowman |
| 8,316,915 | B2 | 11/2012 | Drifka et al. |
| 8,347,937 | B2 | 1/2013 | Murphy |
| 8,408,274 | B2 | 4/2013 | Dwarka |
| 8,434,817 | B2 | 5/2013 | Sawada |
| 8,448,689 | B2 | 5/2013 | Roberts et al. |
| 8,550,142 | B2 | 10/2013 | Gaskill et al. |
| 8,851,146 | B2 | 10/2014 | Dwarka |
| 2003/0127198 | A1 | 7/2003 | Court et al. |
| 2003/0173040 | A1 | 9/2003 | Court et al. |
| 2003/0188837 | A1 | 10/2003 | Varley et al. |
| 2008/0035282 | A1 | 2/2008 | Coenraets |
| 2008/0093037 | A1 | 4/2008 | Kraeutler |
| 2009/0277593 | A1 | 11/2009 | Stewart |
| 2009/0278703 | A1 | 11/2009 | Iglesias Ballester |
| 2010/0006239 | A1 | 1/2010 | Kraeutler |
| 2010/0269985 | A1 | 10/2010 | Hanley et al. |
| 2010/0307697 | A1 | 12/2010 | Perkowitz |
| 2011/0067820 | A1 | 3/2011 | Hsu et al. |
| 2011/0094689 | A1 | 4/2011 | Dwarka |
| 2011/0108214 | A1 | 5/2011 | Komatsu et al. |
| 2011/0146918 | A1 | 6/2011 | Vestal |
| 2011/0203742 | A1 | 8/2011 | Lin |
| 2011/0247761 | A1 | 10/2011 | Lin |
| 2011/0247762 | A1 | 10/2011 | Lin |
| 2012/0043029 | A1 | 2/2012 | Gaskill et al. |
| 2012/0222824 | A1 | 9/2012 | Lin |
| 2012/0291963 | A1 | 11/2012 | Marocco |
| 2013/0048229 | A1 | 2/2013 | Dwarka |
| 2013/0068400 | A1 | 3/2013 | Dwarka |
| 2013/0098564 | A1 | 4/2013 | Jang |
| 2013/0269883 | A1 | 10/2013 | Dwarka |

* cited by examiner

COIL BRUSH CURTAIN ASSEMBLY

RELATED APPLICATIONS

This application claims priority under 35 U.S.C. §119(e) to U.S. Provisional Application No. 61/587,785, entitled "COIL BRUSH CURTAIN ASSEMBLY," filed on Jan. 18, 2012, which application is incorporated herein by reference in its entirety.

BACKGROUND

Traditional window curtain installations are configured to provide for both functional and aesthetic purposes. In a conventional curtain, one functional goal is to reduce light impinging upon dwelling areas or other interior spaces coming from an exterior source, for example, through windows. Other functions include providing for selective placement of shading portions of the curtain to restrict or permit light as desired. In some examples, this can be accomplished by winding a curtain around a roller operated by hand. An operator can raise or lower a curtain over an opening depending upon, for example, a desired amount of light. In other examples, the roller can be operated via a motor to raise and lower the curtain, covering, for example, exterior facing windows to any desired degree.

Typically, consumers select curtains based not only on the functional aspects provided, but also based on the aesthetic of the curtain. In some situations the physical layout of a space (e.g., a building, home, or office) dictates the shape and configuration of a given curtain. Traditional curtain designs can fail to adapt to physical layout of the spaces in which they are to be installed. Conventional installations can require frame tracks to deal with the variety of physical layouts, which can result in damage to the surfaces on which they are installed. Further, the physical layouts of various installation spaces can vary so widely as to prevent use of tracks. For example, windows are installed in a variety of sizes and shape, each having framing that defines a wide variety of installation spaces. In some examples, window framing and the narrowness of available space can prevent the use of tracks. With or without tracks some conventional curtains fail to block light passing through exterior openings, for example, on edge portions of an installed curtain.

SUMMARY

In broad overview, various aspects are directed to curtain assemblies having fabric curtains with brush edges that are mated to the fabric curtain. The brush edges are configured to contact the side edges of the opening in which the curtain assembly is installed and remain in contact with the side edges during movement of the curtain. The covered openings are typically bounded by a frame having an interior portion, side edges, and top and bottom rails. For windows, the window structures (e.g., glass panes and frame) establish the depth of the interior portion of the frame in which the curtain assembly can be installed. During movement of the curtain the brush edges remain connected to the side edges of the opening preventing, for example, penetration of light.

According to one aspect, a curtain assembly is provided. The curtain assembly comprises a curtain having a first and a second edge, wherein the curtain is selectably moveable vertically between an open position and a recessed position, a roller attached to the curtain, wherein the roller is constructed and arranged to rotate thereby transitioning the curtain between the open position wherein the curtain is extended from the roller and the recessed position wherein the curtain is wound around the roller, and a first and a second brush edge connected to the first and the second edges of the curtain, wherein the first and second brush edges extend laterally from the first and second edge of the curtain to provide a connection to an installed surface.

According to one embodiment, the first and second edges include vertical edges of the curtain when in the open position. According to one embodiment, the first and second edges include opposite edges of a flat section of the curtain panel. According to one embodiment, the first and second edges are joined by a width of the curtain. According to one embodiment, the first and second edges are parallel edges of a rectangular curtain.

According to one embodiment, the connection to the installed surface is configured to provide a light seal between the curtain and the installed surface during transition from the open position to the recessed position. According to one embodiment, the first and second brush edges are configured to deflect and to maintain the connection to the installed surface during movement of the curtain. According to one embodiment, the installed surface includes side edges of a window frame and the first and second brush edges respectively provide the connection to the side edges of the window frame.

According to one embodiment, the curtain assembly further comprises a first and a second side track rail configured to receive respective ones of the first and the second brush edges. According to one embodiment, the first and the second side track rails are constructed and arranged to provide a channel for receiving the respective ones of the first and second brush edges. According to one embodiment, wherein the first and the second side track rails are configured to provide a respective channel for receiving the first and second brush edges, wherein the respective channels extends around the respective brush edge and around a portion of a respective edge of the curtain.

According to one embodiment, the roller comprises offset portions on each end of the roller, wherein the offset portions each comprise a reduced diameter portion of the each end of the roller. According to one embodiment, the offset portions are configured to receive respective ones of the first and the second brush edges responsive to winding of the curtain around the roller. According to one embodiment, the curtain assembly further comprises a roller guide configured to position the curtain proximate to a covered opening. According to one embodiment, the roller guide is configured position the curtain and the first and second brush edges to be received by a first and a second side track rail configured to receive respective ones of the first and the second brush edges.

According to one embodiment, the curtain assembly further comprises at least one rail attached to the curtain, wherein the at least one rail is constructed and arranged to provide lateral stability in the curtain. According to one embodiment, wherein the at least one rail is configured to maintain the connection between the first and the second brush edges and the installed surface. According to one embodiment, the at least one rail is configured to travel within a first and a second side track rail configured to receive respective ones of the first and the second brush edges. According to one embodiment, the curtain includes a plurality of rail assemblies constructed and arranged to include a spacing between each of the plurality of rail assemblies, wherein the spacing is configured to minimize the overlap of each of the plurality of rail assemblies when the curtain is wound around the roller in the recessed position.

According to one embodiment, the roller comprises an outer roller and at least one inner roller, wherein the at least one inner roller defines an offset portion of the roller. According to one embodiment, the at least one inner roller is constructed and arranged having a smaller diameter relative to the outer roller. According to one embodiment, the at least one inner roller is slidably connected to the outer roller. According to one embodiment, the at least one inner roller is configured to move laterally within the outer roller during rotation to maintain a positioning of a respective brush edge within the offset portion.

Still other aspects, embodiments, and advantages of these exemplary aspects and embodiments, are discussed in detail below. Any embodiment disclosed herein may be combined with any other embodiment in any manner consistent with at least one of the objects, aims, and needs disclosed herein, and references to "an embodiment," "some embodiments," "an alternate embodiment," "various embodiments," "one embodiment" or the like are not necessarily mutually exclusive and are intended to indicate that a particular feature, structure, or characteristic described in connection with the embodiment may be included in at least one embodiment. The appearances of such terms herein are not necessarily all referring to the same embodiment. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

Various aspects of at least one embodiment are discussed below with reference to the accompanying figures, which are not intended to be drawn to scale. Where technical features in the figures, detailed description or any claim are followed by reference signs, the reference signs have been included for the sole purpose of increasing the intelligibility of the figures, detailed description, and claims. Accordingly, neither the reference signs nor their absence, are intended to have any limiting effect on the scope of any claim elements. In the figures, each identical or nearly identical component that is illustrated in various figures is represented by a like numeral. For purposes of clarity, not every component may be labeled in every figure. The figures are provided for the purposes of illustration and explanation and are not intended as a definition of the limits of the invention. In the figures:

DETAILED DESCRIPTION

Figure 1B:
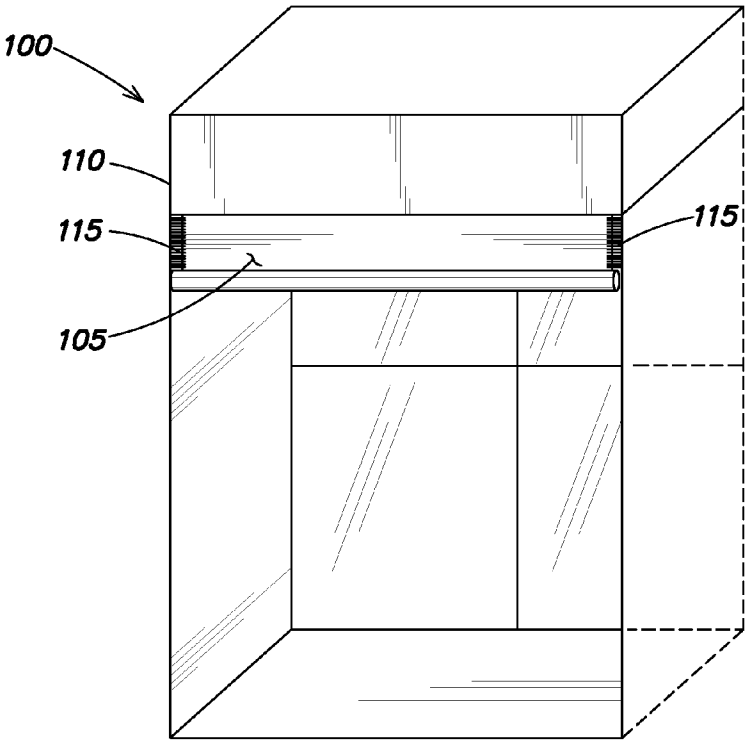
FIGS. 1A-E illustrate example embodiments of curtain shade assemblies, according to aspects of the present invention.
Figure 1A:
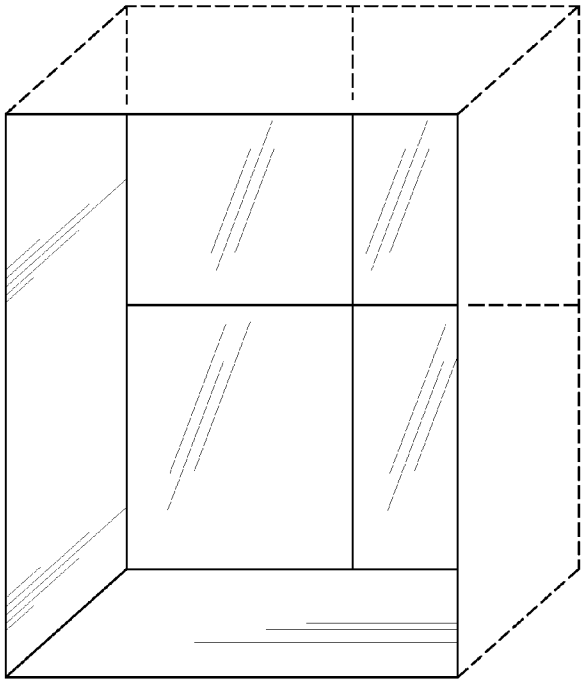

According to some embodiments, curtain assemblies can be installed covering windows in a dwelling. The curtain assembly can be installed within the space defined by the window frame. For example, an exterior window can be installed in a frame in a wall of a house. The frame and installed window can define an interior portion of the frame or window box. FIG. 1A illustrates one type of exterior window having an interior window frame which defines an installation space. Shown in FIG. 1B is an exemplary curtain assembly 100, including a head box 110 that houses the structures of the curtain assembly, discussed in greater detail below, including fabric curtain 105. Curtain 105 is mated to brush edges 115. The brush edges 115 extend from the side of the curtain and are configured to form a moveable seal between the curtain and sides of the window frame in which the curtain assembly is installed. Further, the brush edges are configured to slide along the side edges of the interior portion of the window frame and remain in contact with the side edges during movement of the curtain. In some embodiments, head box 110 is installed so that at least a portion of the head box is disposed within the space defined by the interior portion of the window frame. In some embodiments, the head box can be attached to an upper rail of the window frame. In other embodiments, the head box can be attached to mounting brackets secured to the side edges of the frame.

According to some aspects, energy properties of the curtain assembly, including noise reduction and/or energy conservation properties, can be improved by positioning the curtain 105 closer to the opening to be covered, e.g., the window of FIG. 1B. In some embodiments, structures within the head box 110, discussed in greater detail below, are configured to control positioning of the curtain.

In some embodiments, bottom rail 120 can be connected to curtain 105. In other embodiments, bottom rail 120 can be formed as a pocket in curtain 105 at a folded over portion of curtain 105. Weight(s) (not shown) can be inserted in the pocket to provide an operational force applied to curtain 105. The weight(s) are configured to assist in the operation of the curtain. The weights can also be configured to provide stability within the fabric curtain to hold the curtain taught. The weights inserted in the fabric pocket or the weight of bottom rail 120 can be configured in conjunction with manual or motorized structures (not shown) for raising and lowering the curtain 105 between open and closed positions over a covered opening.

Figure 1C:
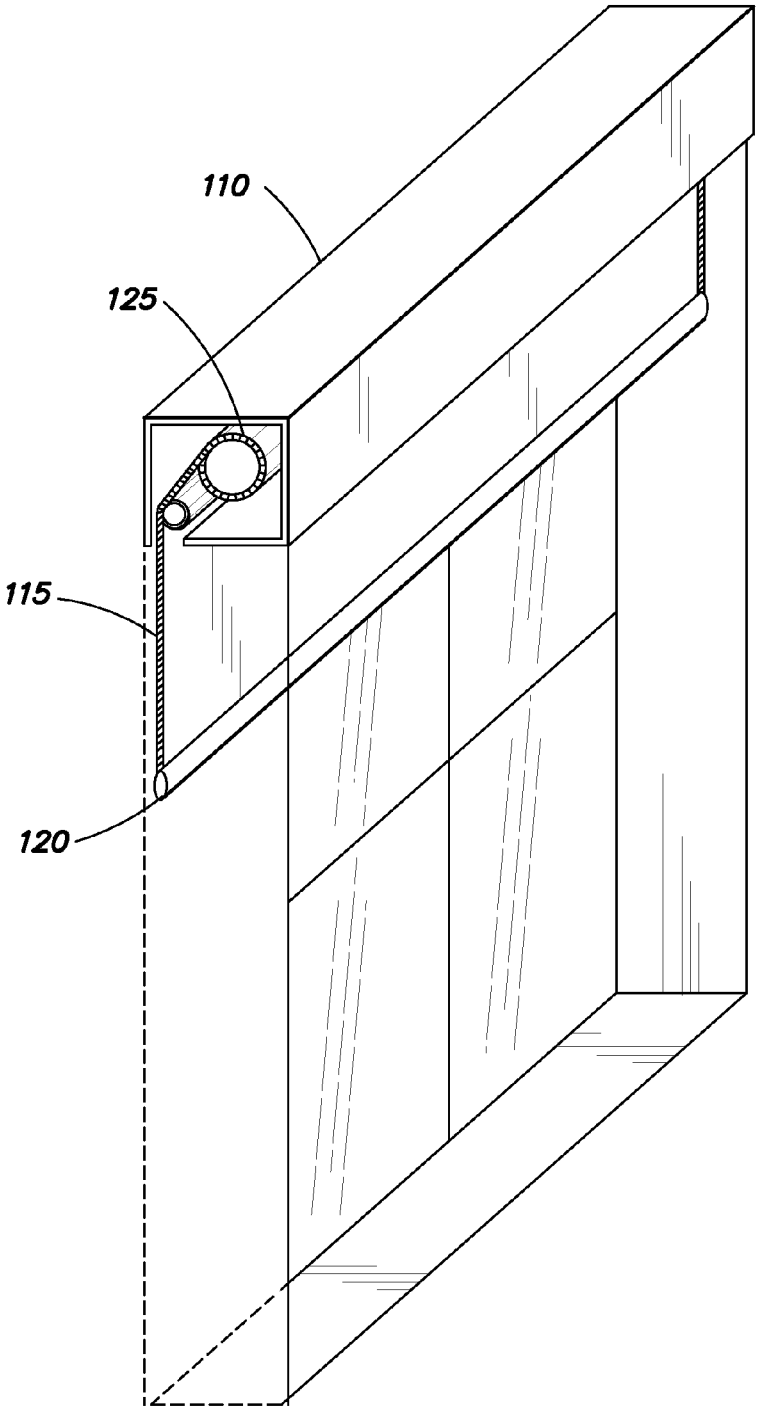

Shown in FIG. 1C is an exploded perspective view of the head box 110 including a roller tube 125 around which curtain 105 is wound. Brush edges 115 are mated to the curtain 105. Brush edges 115 can be adhered to the curtain using, for example, glue tape. The brush edges can be configured to be flexible when attached, so as to wind around roller tube 125 along with curtain 105 as the curtain is operated into a closed position (stored within head box 110). Brush edges 115 are also configured to unwind from roller tube 125 along with curtain 105 as the curtain transitions into an open position (covering an opening).

In some embodiments, roller tube 125 includes offset portions on the ends of the roller tube. The offset portions on the ends of roller tube are constructed with a narrower diameter than the main body of the roller tube 125. In some examples, the brush edges 115 are wider than the curtain to which they are mated. The offset portions can be positioned on the ends of the roller tube to accept the additional width of the brush edges 115. The additional width of the brush edges can be accommodated within the space provided by the narrower diameter of the offset portions. In some embodiments, the offset portions are constructed with a narrower diameter to provide spacing for the brush edges 115 when wound around roller tube 125. In some settings, the small spaces provided for in the interior portion of an opening to be covered (e.g., a window) require that the wound curtain and brush edges occupy a minimum amount of space. The additional width of the brush edges 115 can cause a roller tube to bind within a head box if the additional width of the brush edges is not given additional space by, for example, offset portions on the roller tube.

Figure 1D:
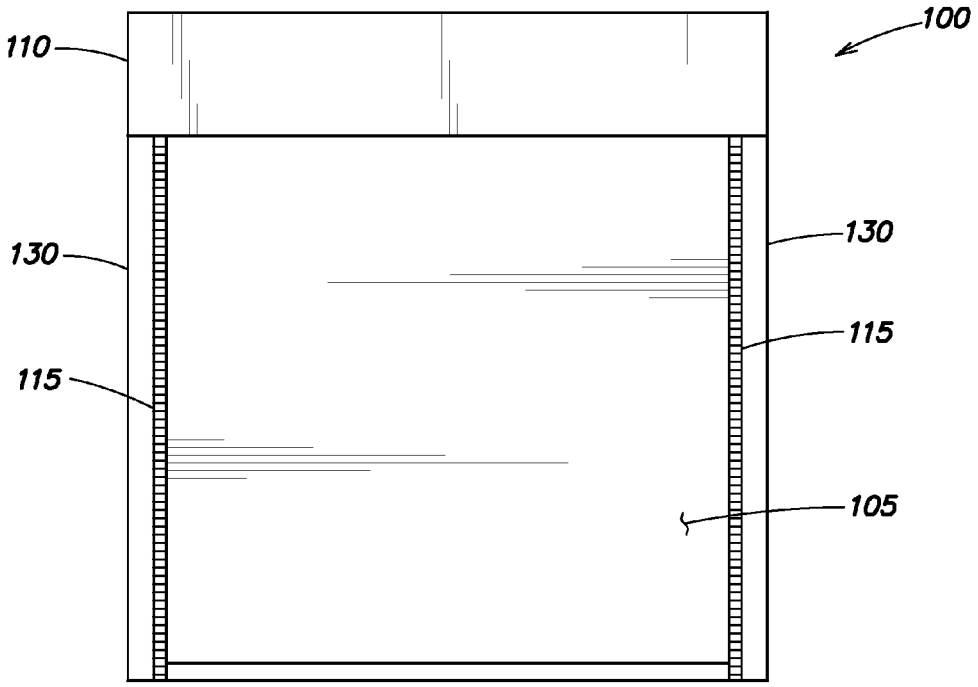

Shown in FIG. 1D is another example of a curtain assembly 100 including optional side tracks at 130. Optional side tracks can be installed on the inner side edges of the window frame to assist in the operation of curtain 105. Side tracks at 130 can provide additional stability to curtain 105 and brush edges 115 during operation. Side tracks at 130 can also be configured to insure brush edges 115 do not overly deflect from their connections to the side edges of the window frame. Too much deflection in the brush edges 115 can permit light or other objects to penetrate the seal formed between the curtain 105, brush edges 115, and the side edges of the frame in which the curtain assembly 100 is installed.

Figure 6:
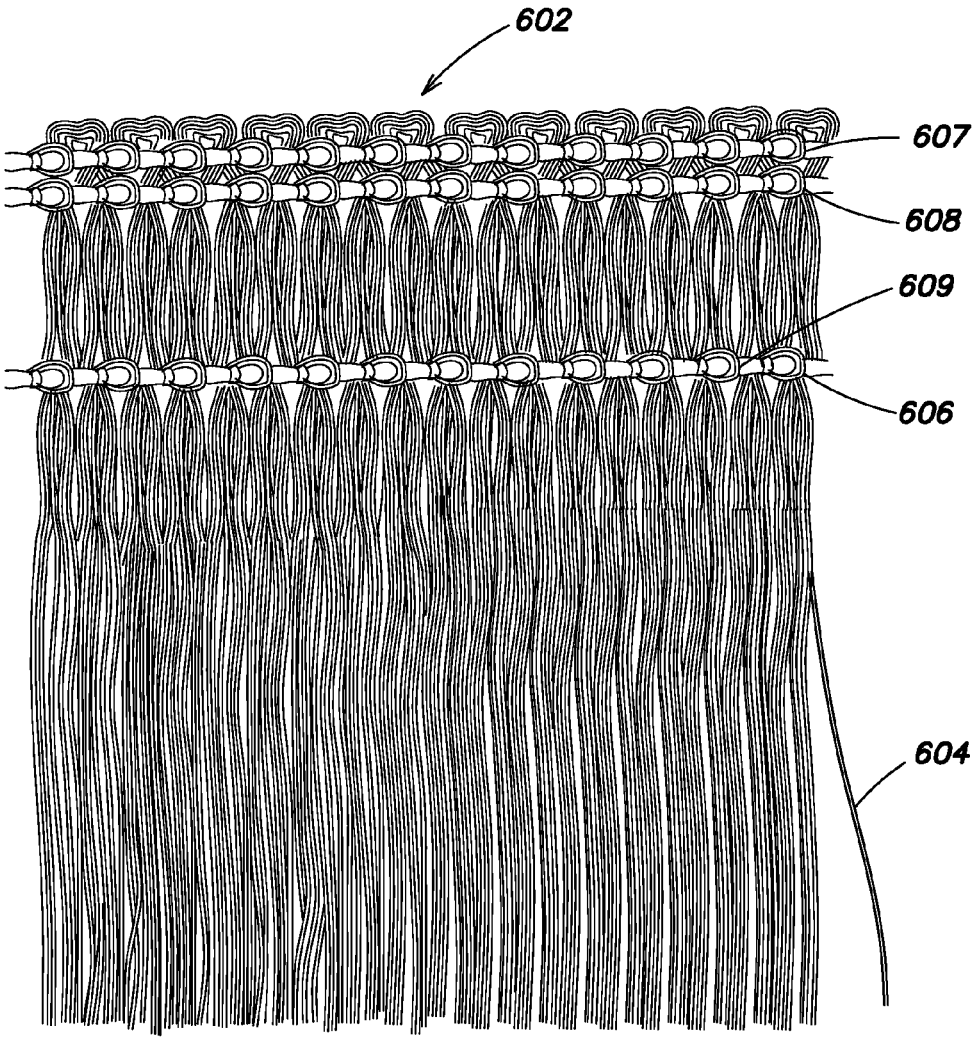
FIG. 6 illustrates an example portion of a curtain and brush edge, according to aspects of the present invention.

In some embodiments, brush edges 115 can be constructed to be stiff, so that deflection or bending of the bristles that make up brush edges is minimal. Brush edges can also be constructed and arranged so that the bristles are biased to deflect in the operating plane of the curtain as it moves between open and closed positions. The brush edges can be constructed of bristles bound together. Shown in FIG. 6 is an example section of one embodiment of a curtain 602 and mated brush edge 604. In one example, the bristles are bound into bundles, and then the bundles are layered together to form a brush edge. Various dimensions can be provided by different embodiments of the brush edge.

The brush edges are configured to extend the length of the curtain and be flexible so as to permit the brush edges to be wound around a roller tube. In some embodiments, the brush edge is constructed and arranged of bristles bound together by a fastener 606 at 607, 608, and 609. In some embodiments, the binding can be configured to bias the deflection of the bristles along the plane of the curtain on which the brush edges are installed. Fastener 606 can be constructed of thread tied or woven into each section of bristles. In some examples, the thread can be constructed of synthetic or natural fibers. The bristles and/or sections of bristles can be layered to provide additional stiffness in brush edge 604. In one example, brush edge 604 includes two layers of bundles of the bristles. In some embodiments, the bundles of bristles in adjacent layers are offset to increase the stiffness of the bristles towards the adjacent layers, biasing the brush edges so they sweep against contacting surfaces.

Figure 1E:
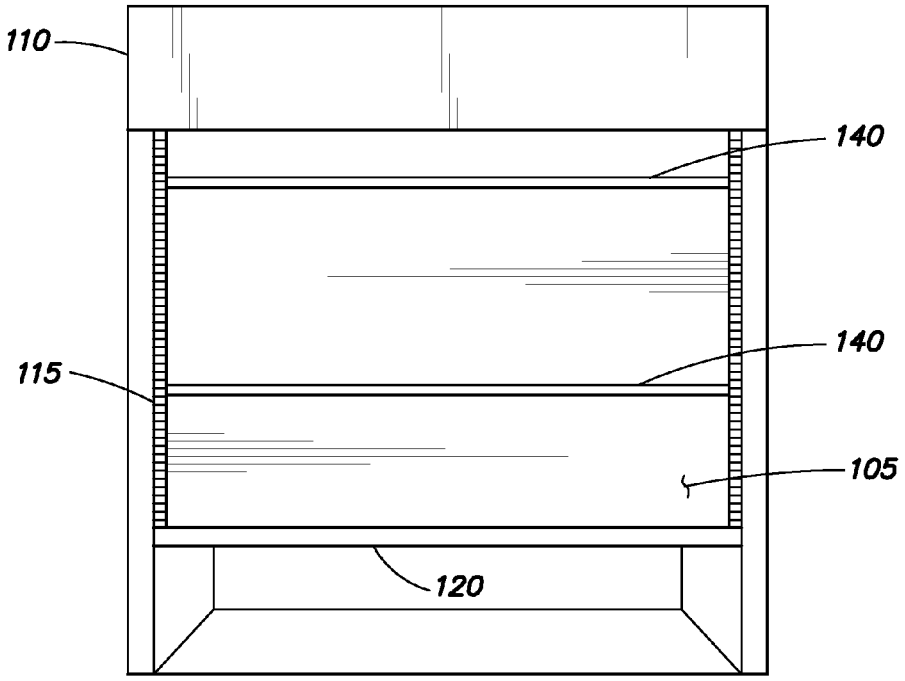

Increasing the stiffness of the bristles of the brush edges can improve the connection between the bristles and, for example, the edges of the window frame. However, the increased stiffness in the bristles results in increased force exerted on the curtain which can cause warping or bowing in the curtain 105. In some embodiments, warping and/or bowing of the curtain can be compensated by increasing the weight of bottom rail 120. For example, the bottom rail 120 can be constructed of a rigid metal that holds the curtain 105 taught, resisting the pressure exerted by brush edges 115 on the curtain. In other embodiments, fabric stiffeners can be attached to the curtain 105 (e.g. FIG. 1E at 140). The fabric stiffeners are configured to extend across the width of the curtain at intervals to prevent warping and/or bowing of the flexible fabric curtain. In some examples, stiffeners can spaced approximately at 28-32" intervals along the length of the curtain 105, although other spacing intervals can be used. U.S. Application Publication No. 2011-0094689, incorporated herein by references in its entirety, describes various implementations of curtains and curtain stiffeners that can be used in conjunction with some embodiments discussed herein.

The fabric stiffeners can be configured to assist in keeping the brush edges of the curtain in communication with the edges of any frame in which a curtain assembly is installed. During operation of the curtain assembly, a curtain can be operated between an open and closed position (and anywhere in between). During operation of the curtain assembly the brush edges remain in communication with the side edges of, for example, a window box as the curtain is operated between the open and closed positions. Maintaining a seal between the curtain and the edges of the window box via the brush edges during operation prevents or limits penetration of light into an interior space of, for example, a home or office building.

According to another aspect, a curtain assembly is provided having a curtain with brush edges configured to mate with the side edges of a window box during operation. According to one embodiment, the curtain assembly is configured to fit within the space defined by a window frame and the window to be covered. The window frame and window define the interior portion of the space in which a window is installed, the window box. Typically a window is recessed into a wall so as to be flush or near to flush with the exterior surface of a structure in which it is installed, shown for example in FIG. 1A. In some embodiments, the curtain assembly can include a head box configured to be installed within the recessed portion of the window box. In one example, a head box of a curtain assembly extends horizontally across the width of the window box, shown for example, in FIG. 1B. Further the head box can be attached to the top of the frame to support the curtain assembly. In other embodiments, the head box can be configured to install horizontally above the window box.

The curtain assembly can be constructed and arranged to open and close a curtain to cover a window, shown for example in 1C. In one example, the curtain is connected to a roller tube. Rotation of the roller tube causes the curtain to raise and lower into position. The curtain of the curtain assembly can be constructed of fabric materials, including for example, natural fibers, synthetic fibers, pliable plastics, etc. In some embodiments, a fabric curtain can be configured to be flexible, and in particular flexible to wind around a roller tube installed in the head box. In some examples, the materials for the curtain can be selected based on aesthetic or design, and in other examples, selected based on specific energy properties (e.g. noise or sound reducing properties). In some further examples, conventional fabrics can be installed having a low energy coating, a silver lining, or known insulation properties, among other examples.

Figure 2A:
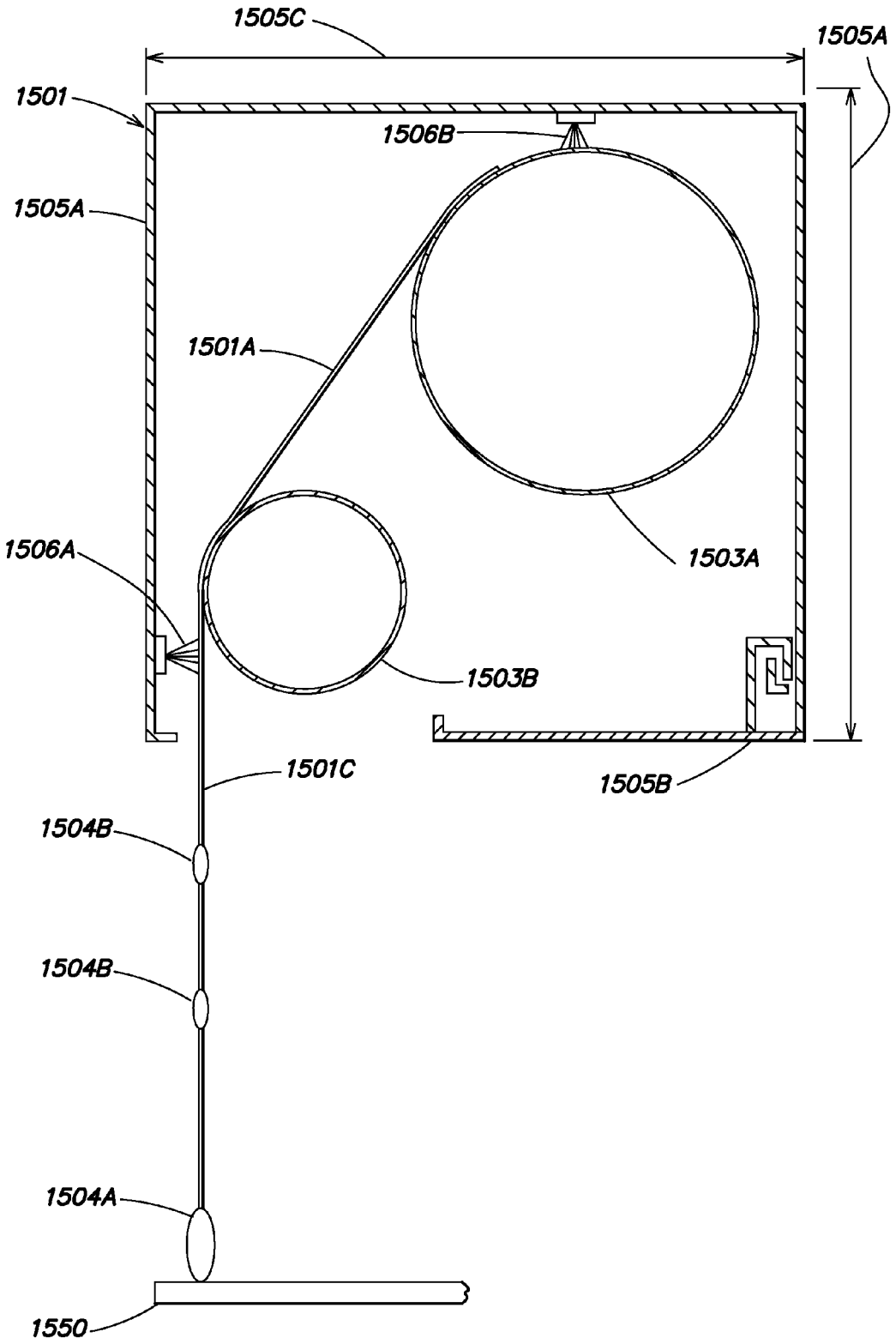
FIG. 2A illustrates an example of curtain assembly and curtain wound around a connected roller, according to aspects of the present invention.

The roller tube can be operatively connected to a motor, permitting automatic raising and lowering of the curtain. The roller tube can also be configured to operate manually (e.g., via an attached draw cord, chain, or by exerting force on a bottom rail) to raise and lower the curtain. Shown in FIG. 2A is an example of a head box 1501 for a curtain assembly. In one embodiment, head box 1501 is constructed and arranged to include a curtain 1501A wound around a roller tube 1503A. FIG. 2A illustrates a side view of an example head box 1501. Head box 1501 is constructed and arranged to house the roller tube 1503A and other curtain assembly structures. Roller tube 1503A is configured to wind and unwind at least one curtain, for example, 1501A to position the curtain 1501A at or between an open and a closed position.

In one embodiment, curtain 1501A can be a fabric curtain. In one example, curtain 1501A is constructed of a flat fabric panel or a substantially flat fabric panel. The fabric curtain can be composed of natural or synthetic materials and/or natural fibers or synthetic fibers. Each one of a pair of side edges of curtain 1501A is mated with a flexible brush edge 1501C configured to slideably mate with the edges of any frame in which curtain 1501A and/or the curtain assembly is installed. Flexible brush edges 1501C can be constructed and arranged to prevent penetration of light along the edges of curtain 1501A. Flexible brush edges 1501C can be configured to deflect during operation of curtain 1501A to maintain connection with side edges of a window frame. In some embodiments, flexible brush edges 1501C are further configured to coil around roller tube 1503A. In further embodiments, flexible brush edges 1501C can be configured to coil around roller tube 1503A with minimal overlap. Roller tube 1503A can be constructed with offset portions having smaller diameter to accept the additional thickness of the brush edges as they are wound around roller tube 1503A.

Curtain 1501A can be constructed of a variety of materials. In some examples the construction material can depend on a desired energy value for the curtain assembly and/or a noise reduction capability desired. In some examples, a fabric curtain can include a lining configured to improve the energy characteristics of the curtain and/or the curtain assembly. In other examples, other insulated fabric curtains can be employed. Low energy emissions curtain can be configured to limit heat and/or cold loss depending upon the environment in which the curtain assembly is installed.

Roller guide 1503B can be installed within the head box 1501 to position the curtain 1501A closer to the opening to be covered. In other embodiments, roller guide 1503B can be positioned within a head box to insure curtain 1501A and brush edges 1501C are disposed within, for example, a window frame. In one example, roller guide 1503B is constructed having a 1.0"+/−0.25" diameter and roller tube 1503A is constructed with a diameter of 4.0". In some embodiments, different roller guides having different diameters can be installed in the head box 1501. Further the diameter of the roller guide can be constructed based on the dimensions of a window box in which the curtain assembly is installed to place curtain 1501A closer to any opening covered by the curtain assembly.

In some embodiments, the dimensions of the head box at 1505A and C are constructed to fit within a variety of window frames. For example, the head box 1501 can be constructed having a height of 5.5" at 1505A and depth 1505C of 5". Other dimensions for the height and depth of the head box can be constructed according to the dimensions of window and/or window box in which the head box is installed. According to some embodiments, head box 1501 can be constructed with a closure cap 1505B configured to conceal the interior structures of head box 1501 including roller tube 1503A and roller guide 1503B from an interior side viewing position.

According to some embodiments, brush seals 1506A and 1506B are positioned within the head box 1501 and mated with curtain 1501A to improve energy properties of the curtain assembly, and/or prevent insect intrusion. Brush seals 1506A and 1506B maintain contact with curtain 1501A during operation of the curtain assembly between open and closed positions. In some embodiments, brush seals 1506A and 1506B can be constructed of bristles, a fabric strip, or a resilient and compressible material.

In some embodiments, a bottom rail 1504A can be attached to curtain 1501A. The bottom rail 1504A can be weighted to assist in the operation of the curtain 1501A between an open and closed position. In some examples, bottom rail 1504A can be constructed by folding over a portion of curtain 1501A and inserting weights into the pocket formed at 1504A. In some embodiments, curtain 1501A can be connected to a unitary bottom rail 1504A.

In some embodiments, bottom rail 1504A can include an additional brush seal (not shown) to improve the connection between bottom rail 1504A and a portion of the window frame at 1550. In some embodiments, the bottom rail 1504A can be weighted to assist in the operation of curtain 1501A. The weight of the bottom rail can be configured to cause unwinding of curtain 1501A by gravity upon release of any stopping mechanism. In other embodiments, springs can be included in roller tube 1503A biased to operate roller tube 1503A to wind curtain. The weight selected for bottom rail 1504A can be configured to oppose the operation of the springs.

At 1504B stiffeners can be disposed on curtain 1501A. Stiffeners 1504B are configured to provide lateral rigidity in curtain 1501A. Increased rigidity of curtain 1501A improves the communication of the brush edges 1501C with side edges of the window frame. In some embodiments, the curtain assembly can include optional side tracks to guide the operation of curtain 1501A and brush edges 1501C.

In some embodiments, the optional side tracks can be flush with a wall on which a curtain assembly can be installed. In one embodiment, curtain assemblies that are not recessed in a window frame can include optional side tracks to provide channels on the wall in which the brushes edges can travel.

Figure 2B:
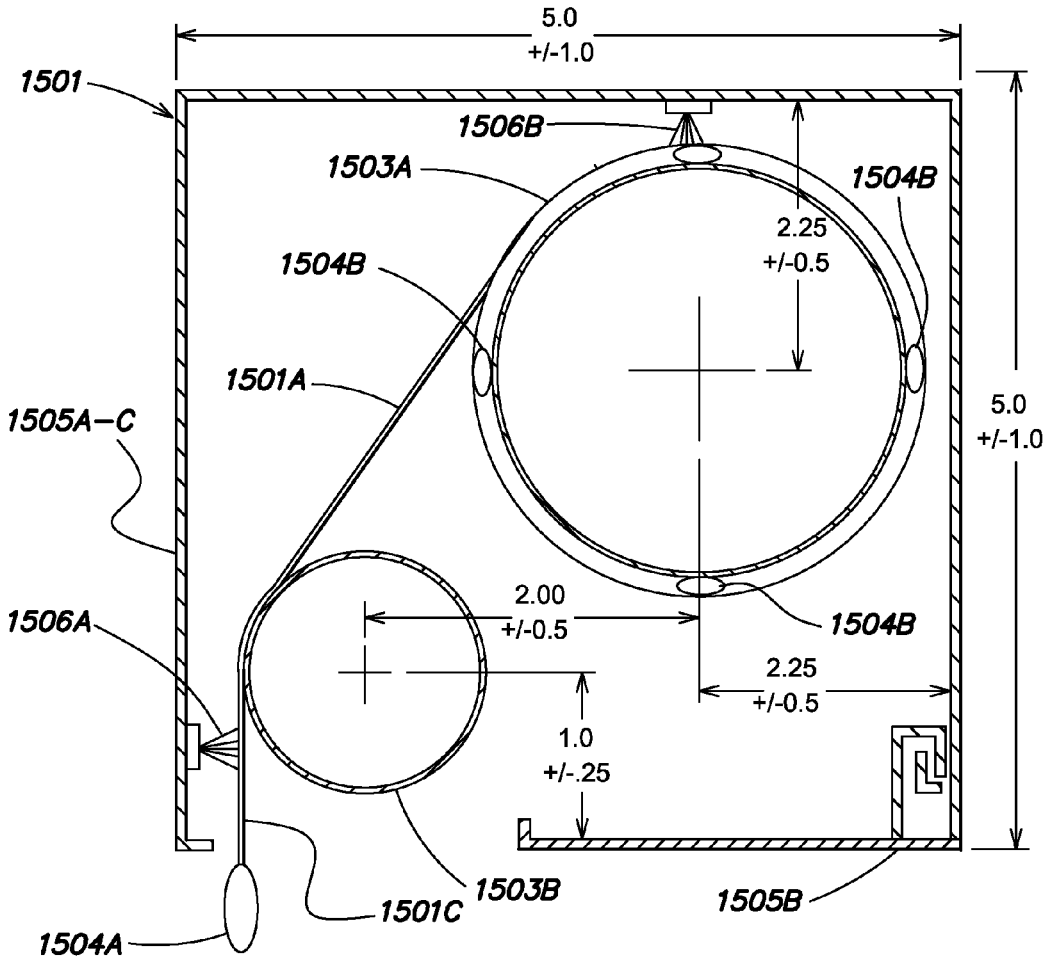
FIG. 2B illustrates an example of curtain assembly and curtain unwound from around a connected roller.

FIG. 2B illustrates an example embodiment of head box 1501 and example dimensions and positioning of the illustrated components, when the curtain 1501A is wound around roller tube 1503A (closed position).

Figure 3A:
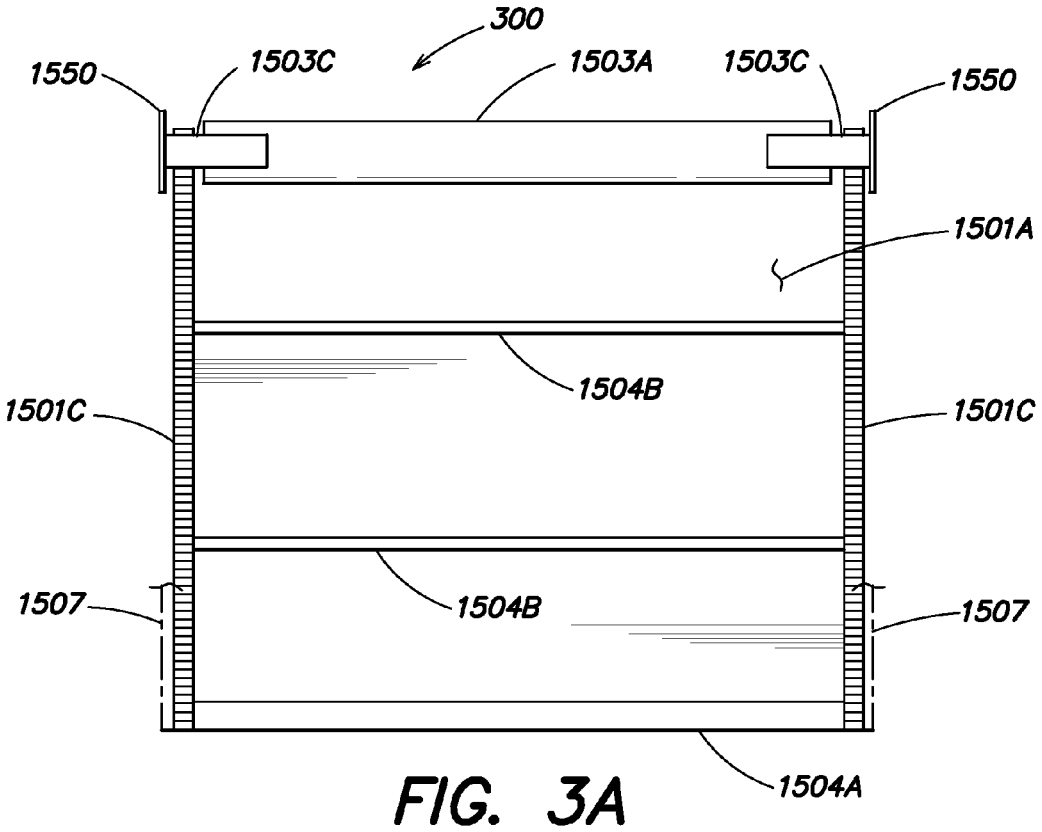
FIGS. 3A-B illustrate example views of a curtain assembly, according to aspects of the invention.
Figure 3B:
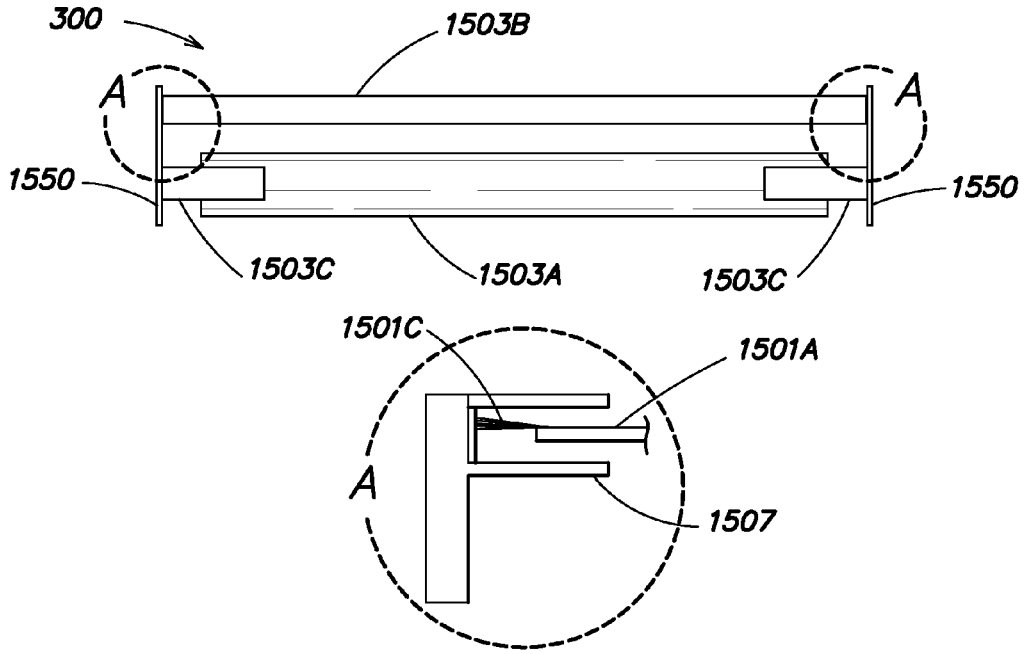

Shown in FIG. 3A is a front view of some of the internal structures of an example curtain assembly 300 which can include a head box, e.g., 1501. Shown in FIG. 3B is a plan view of curtain assembly 300. Optional side tracks for the curtain assembly are shown at 1507. Side tracks 1507 can be installed within any window frame. The side tracks are positioned within the window frame to insure curtain 1501A remains positioned within the window frame. In some embodiments, optional side tracks 1507 are constructed and arranged to improve the energy properties of the curtain assembly 300. The optional side track 1507 can be constructed of a variety of materials, including for example, clear ploy carbonate or aluminum.

Brush edges 1501C are configured to communicate with side tracks 1507 to seal curtain 1501A over the opening covered by curtain assembly 300. When the curtain is in a closed position, brush edges 1501C in communication with side tracks 1507 and curtain 1501A form an air pocket over the covered opening. The air pocket creates additional insulation for the curtain assembly, improving the energy properties of the curtain assembly. In some embodiments, the brush edges 1501C form moveable seals at the connections between side tracks 1507 and the brush edges. The connection can be configured to prevent light seepage at the edges of curtain 1501A. The connection can also be configured to keep insects from passing through the covered opening.

In some embodiments, roller guide 1503B is positioned to feed curtain 1501A and brush edges into side tracks 1507. Side tracks 1507 can be attached to side edges of a window frame. Each side track can be positioned on the side edges of, for example, a window frame to insure curtain 1501A remains within the frame during operation.

Shown in FIG. 3B, roller tube 1503A can be constructed of a main tube 1503A and offset portions 1503C of a diameter less than the main portion of tube 1503A. In some embodiments, roller tube 1503A or offset portions 1503C can be connected to mounting brackets 1550. In other embodiments, head box 1501 can be connected to mounting brackets 1550 and roller tube 1503A or offset portions 1503C can be connected to head box 1501.

In some embodiments, roller tube 1503A can be configured with offset portions at 1503C to house the flexible brush edges 1501C as they are wound around roller tube 1503A. In some embodiments, roller tube 1503A can be mated with offset tubes to form the offset portions. Offset tubes are constructed to fit within or be mated to roller tube 1503A. Examples of the dimensions of the main portion of roller tube 1503A and offset tubes include: main tube diameter 2.0" with offset tube diameter 1.5"; main tube diameter 2.375" with offset tube diameter 1.875"; main tube diameter 2.5" with offset tube diameter 2.0"; main tube diameter 2.625" with offset tube diameter 2.375"; and main tube diameter 3.0" with offset tube diameter 2.5" although in other embodiments, different dimensions can be employed. In some settings, the dimensions of the frame in which a curtain assembly is installed can require smaller or larger dimensions for the structures of the curtain assembly.

Curtain 1501A can be wound around roller tube 1503A over a guide roller 1503B. Roller guide 1503B can be installed within head box 1501 to position curtain 1501A proximate to any opening covered by a curtain assembly. In some embodiments, roller guide 1503B insures the positioning of curtain 1501A without need for side tracks 1507. Shown at 1504B are optional fabric stiffeners. The fabric stiffeners are constructed to extend laterally across curtain 1501A. The fabric stiffeners can ride within side tracks at 1507 during operation of the curtain 1501A between its open and closed positions. Shown at view A, is an exploded plan view of an optional side track 1507, curtain 1501A, and brush edge 1501C. The optional side tacks can be configured to increase the stability of the curtain 1501A within an installed position. Further, optional side tracks 1507 can be configured to improve the energy characteristics of the curtain assembly by improving the seal made by brush edges.

Figure 5A:
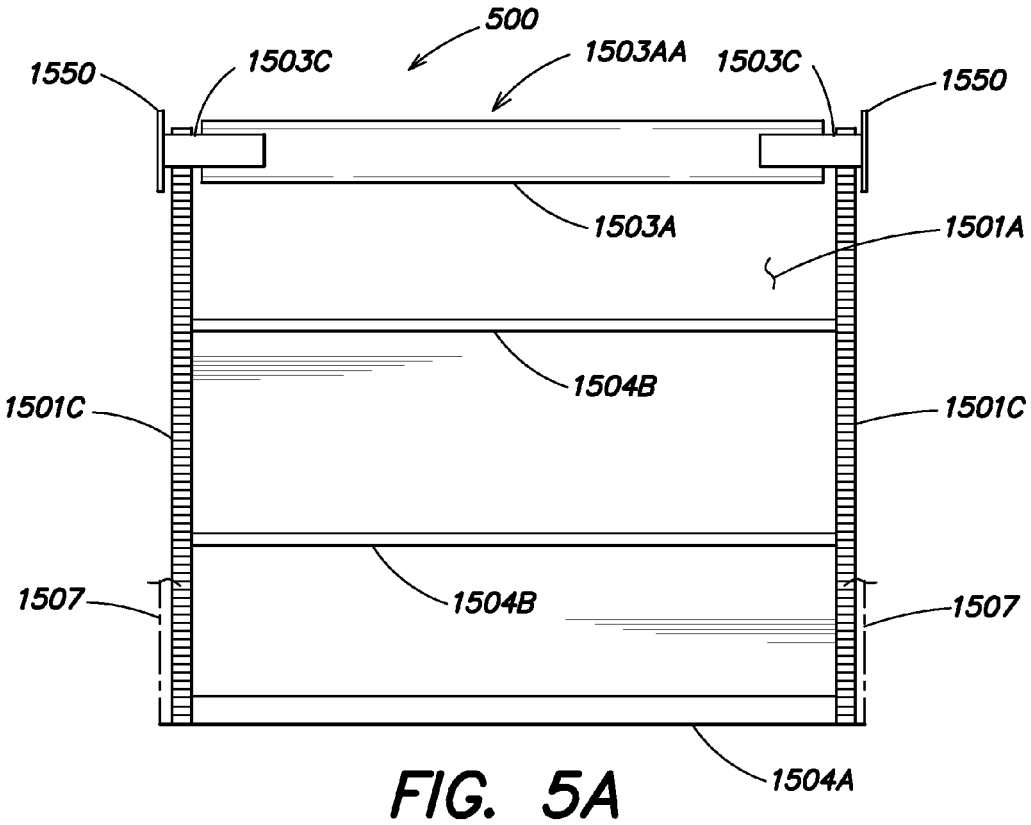
FIG. 5 A-B illustrate example views of a curtain assembly, according to aspects of the invention.
Figure 5B:
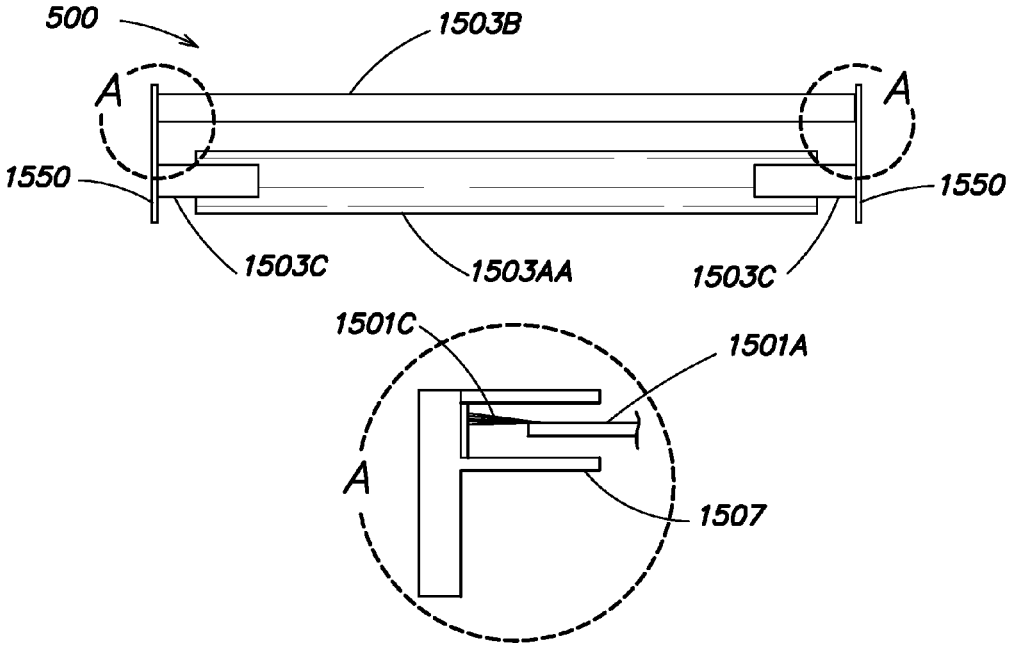

Shown in FIG. 5A is a front view of some of the internal structures of an example curtain assembly 500 which can include a head box, e.g., 1501. Shown in FIG. 5B is a plan view of curtain assembly 500. Optional side tracks for the curtain assembly are shown at 1507. Side tracks 1507 can be installed within any window frame. The side tracks are positioned within the window frame to insure curtain 1501A remains positioned within the window frame. In some embodiments, optional side tracks 1507 are constructed and arranged to improve the energy properties of the curtain assembly 500.

Brush edges 1501C are configured to communicate with side tracks 1507 to seal curtain 1501A over the opening covered by curtain assembly 500. When in a closed position brush edges 1501C in communication with side tracks 1507 and curtain 1501A forms an air pocket over the covered opening. The air pocket creates additional insulation for the curtain assembly, improving the energy properties of the curtain assembly. In some embodiments, the brush edges 1501C form moveable seals at the connections between side tracks 1507 and the brush edges. The connection can be configured to prevent light seepage at the edges of curtain 1501A. The connection can also be configured to keep insects from passing through the covered opening. In some embodiments, roller guide 1503B is positioned to feed curtain 1501A into side tracks 1507. Side tracks 1507 can be attached to side edges of a window frame. Each side track can be positioned on the side edges of, for example, a window frame to insure curtain 1501A remains within the frame during operation.

As discussed above, a roller tube can be constructed of a main tube 1503A and offset portions 1503C of a diameter less than the main portion of tube 1503A. A curtain and brush edges can be wound around a roller tube to operate the curtain between the open and closed positions. Shown in FIGS. 5A-B and FIGS. 4A-B, is another embodiment of a roller tube and curtain assembly. Shown at 1503AA is a roller tube assembly. Roller tube assembly is illustrated from a side view in FIGS. 4A and 4B, which can include an inner tube 1503E and an outer tube 1503D and offset portions 1503C (FIGS. 5A-B). Returning to FIGS. 5A-B, shown is roller tube assembly 1503AA having outer tube 1503D. Outer tube 1503D can be attached to fabric curtain 1501A. Responsive to rotation of outer tube 1503D curtain 1501A will move between open and closed positions. Outer tube 1503D can be configured to slideably mate with an inner tube 1503E. The movement of outer tube 1503D can be configured to assist in winding curtain 1501A and brush edges 1501C around outer tube 1501D. In particular, lateral movements of outer tube 1501D insures a tight winding of curtain 1501A and insures the positioning of brush edges 1501C on offset portions 1503C during operation.

Further, small lateral movements of outer tube 1501D can be configured to insure that curtain 1501A and brush edges 1501C remain centered in a covered opening during movement of the curtain. Shown in FIGS. 4A-B inner tube 1503E includes a grove 1503G that can extend the length of inner tube 1503E. Outer tube 1503D includes key stub 1503F configured to slideably mate with grove 1503G. The key and grove structures prevent the inner and outer tubes from rotating relative to each other while permitting lateral movement of the outer tube. In other embodiments, different structures can be used to slideably mate the inner and outer tubes, and in others the positions of the key and grove structures can be reversed.

In some embodiments, roller tube assembly 1503AA can be connected to mounting brackets 1550. In other embodiments, head box 1501 can be connected to mounting brackets 1550 and roller tube assembly 1503AA can be connected to head box 1503A.

Returning to FIG. 5A-B, in some embodiments, roller tube assembly 1503AA can include offset portions at 1503C to house the flexible brush edges 1501C as they are wound roller tube 1503A. In some embodiments, roller tube assembly 1503AA can include offset tubes to form the offset portions. In some examples, offset tubes are constructed to fit within or be mated to an inner tube 1503E, FIG. 4A. Examples of the dimensions of embodiments of the roller tube assembly 1503AA can include: outer tube diameter 2.625", inner tube 2.375", with offset tubes of diameter 1.875"; outer tube diameter 3.0", inner tube 2.5", with offset tubes of diameter 2.0; outer tube diameter 2.375", inner tube 2.0, with offset tubes of diameter 1.5" although in other embodiments, different dimensions can be employed. In some settings, the dimensions of the frame in which a curtain assembly is installed can require smaller or larger dimensions for the structures of the curtain assembly.

Curtain 1501A can be wound around roller tube assembly 1503AA over a guide roller 1503B. Roller guide 1503B can be installed within head box 1501 to position curtain 1501A proximate to any opening covered by a curtain assembly. In some embodiments, roller guide 1503B insures the positioning of curtain 1501A without need for side tracks 1507. Shown at 1504B are optional fabric stiffeners. The fabric stiffeners are constructed to extend laterally across curtain 1501A. The fabric stiffeners can ride within side tracks at 1507 during operation of the curtain 1501A between its open and closed positions. Shown at view A, is an exploded plan view of an optional side track 1507, curtain 1501A, and brush edge 1501C. The optional side tacks can be configured to increase the stability of the curtain 1501A within an installed position. Further, optional side tracks 1507 can be configured to improve the energy characteristics of the curtain assembly by improving the seal made by brush edges.

Figure 4A:
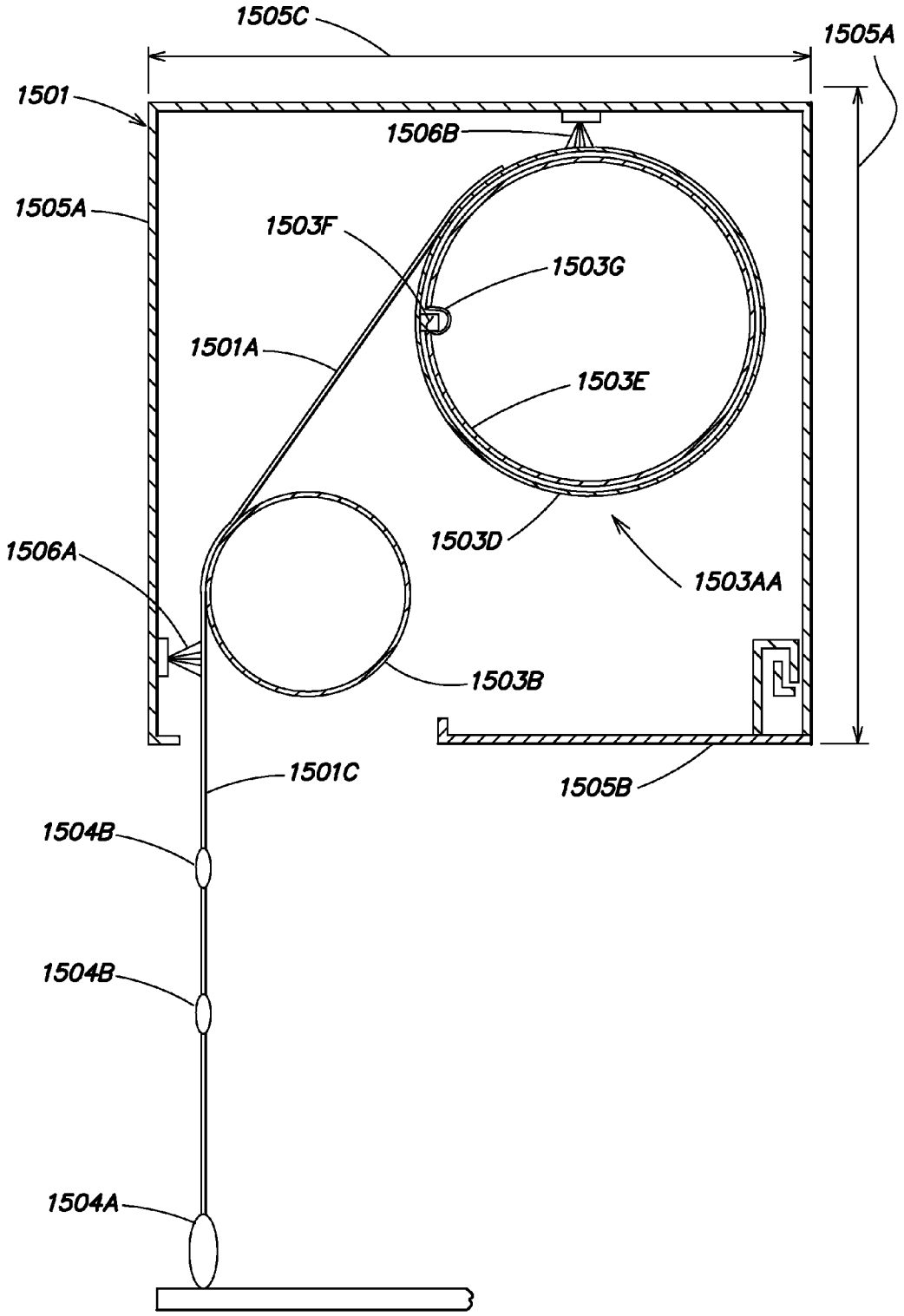
FIG. 4A-B illustrate example views of a curtain assembly, according to aspects of the invention.

Returning to FIGS. 4A-B shown is an example of a head box 1501 for a curtain assembly. In one embodiment, head box 1501 is constructed and arranged to include a curtain 1501A wound around a roller tube assembly 1503AA. FIG. 4A illustrates a side view of an example head box 1501. Head box 1501 is constructed and arranged to house the roller tube assembly 1503AA and other curtain assembly structures. Roller tube assembly 1503AA is configured to wind and unwind at least one curtain, for example, 1501A to position the curtain 1501A at or between an open and a closed position. In one embodiment, curtain 1501A can be a fabric curtain. In one example, curtain 1501A is constructed of a flat fabric panel or a substantially flat fabric panel. The fabric curtain can be composed of natural or synthetic materials and/or natural fibers or synthetic fibers.

Each edge of curtain 1501A is mated with a flexible brush edge 1501C configured to slideably mate with the edges of any window box in which curtain 1501A and/or the curtain assembly is installed. Flexible brush edges 1501C are constructed and arranged to prevent penetration of light along the edges of curtain 1501A. Flexible brush edges 1501C can be configured to deflect during operation of curtain 1501A to maintain connection with side edges of a window frame. In some embodiments, flexible brush edges 1501C are further configured to coil around roller tube assembly 1503AA. In further embodiments, flexible brush edges 1501C are configured to coil around roller tube assembly 1503AA with minimal overlap. Roller tube assembly 1503AA can be constructed with offset portion having smaller diameter to accept the additional thickness of the brush edges as they are wound around roller tube assembly 1503AA.

Curtain 1501A can be constructed of a variety of materials. In some examples, the construction material can depend on a desired energy value for the curtain assembly and/or a noise reduction capability desired. In some examples, a fabric curtain can include a lining configured to improve the energy characteristics of the curtain and/or the curtain assembly. In other examples, other insulated fabric curtains can be employed. Low energy emission curtains can be configured to limit heat and/or cold loss depending upon the environment in which the curtain assembly is installed.

Roller guide 1503B can be installed within the head box 1501 to position the curtain 1501A closer to the opening to be covered. In other embodiments, roller guide 1503B can be positioned within head box to insure curtain 1501A and brush edges 1501C are disposed within, for example, a window frame. In one example, roller guide 1503B is constructed having a 1.0"+/−0.25" diameter and roller tube assembly 1503AA is constructed with an outer diameter of 4.0". In some embodiments, different roller guides having different diameters can be installed in head box 1501. Further, the diameter of the roller guide can be constructed based on the dimensions of a window box in which the curtain assembly is installed to place curtain 1501A closer to any opening covered by the curtain assembly.

In some embodiments, the dimensions of head box at 1505A and C are constructed to fit within a variety of window frames. For example, the head box 1501 can be constructed having a height of 5.5" at 1505A and depth 1505C of 5". Other dimensions for the height and depth of head box can be constructed according to the dimensions of window and/or window box in which the head box is installed. According to some embodiments, head box 1501 can be constructed with a closure cap 1505B configured to conceal the interior structures of head box 1501 including roller tube assembly 1503AA and roller guide 1503B from an interior side viewing position.

According to some embodiments, brush seals 1506A and 1506B are positioned within the head box 1501 and mated with curtain 1501A to improve energy properties of the curtain assembly, and/or prevent insect intrusion. Brush seals 1506A and 1506B maintain contact with curtain 1501A during operation of the curtain assembly between open and closed positions. In some embodiments, brush seals 1506A and 1506B can be constructed of bristles, a fabric strip, or a resilient and compressible material.

In some embodiments, a bottom rail 1504A can be attached to curtain 1501A. The bottom rail 1504A can be weighted to assist in the operation of the curtain 1501B between an open and closed position. In some examples, bottom rail 1504A can be constructed by folding over a portion of curtain 1501A and inserting weights into the pocket formed at 1504A. In some embodiments, curtain 1501A can be connected to a unitary bottom rail 1504A.

In some embodiments, bottom rail 1504A can include an additional brush seal (not shown) to improve the connection between bottom rail 1504A and a portion of the window frame at 1550. In some embodiments, the bottom rail 1504A can be weighted to assist in the operation of curtain 1501A. The weight of the bottom rail can be configured to cause unwinding of curtain 1501A by gravity upon release of any stopping mechanism. In other embodiments, springs can be included in roller tube assembly 1503AA biased to operate roller tube assembly 1503AA to wind curtain. The weight selected for bottom rail 1504A can be configured to oppose the operation of the springs.

At 1504B, stiffeners can be disposed on curtain 1501A. Stiffeners 1504B are configured to provide lateral rigidity in curtain 1501A. Increased rigidity of curtain 1501A improves the communication of the brush edges 1501C with sides edges of the window frame. In some embodiments, the curtain assembly can include optional side tracks to guide the operation of curtain 1501A and brush edges 1501C.

Figure 4B:
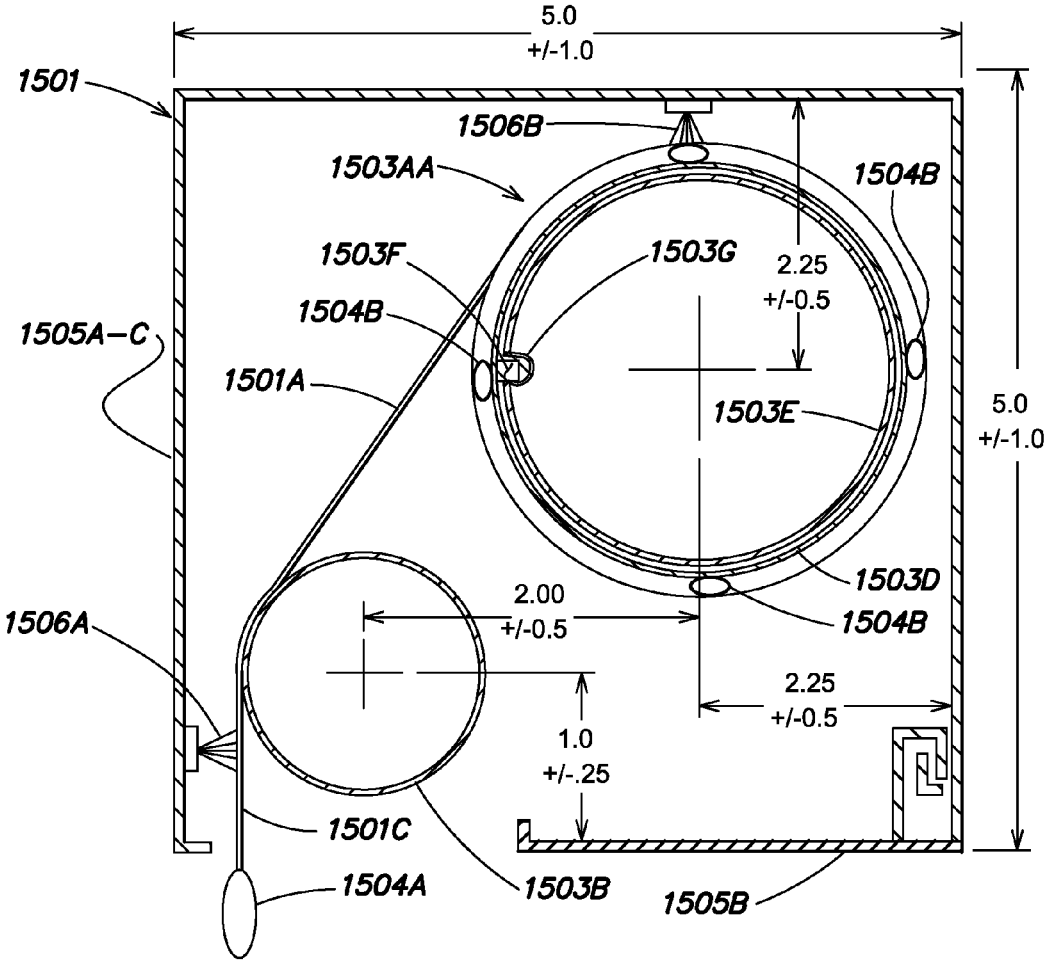
Figure 7:
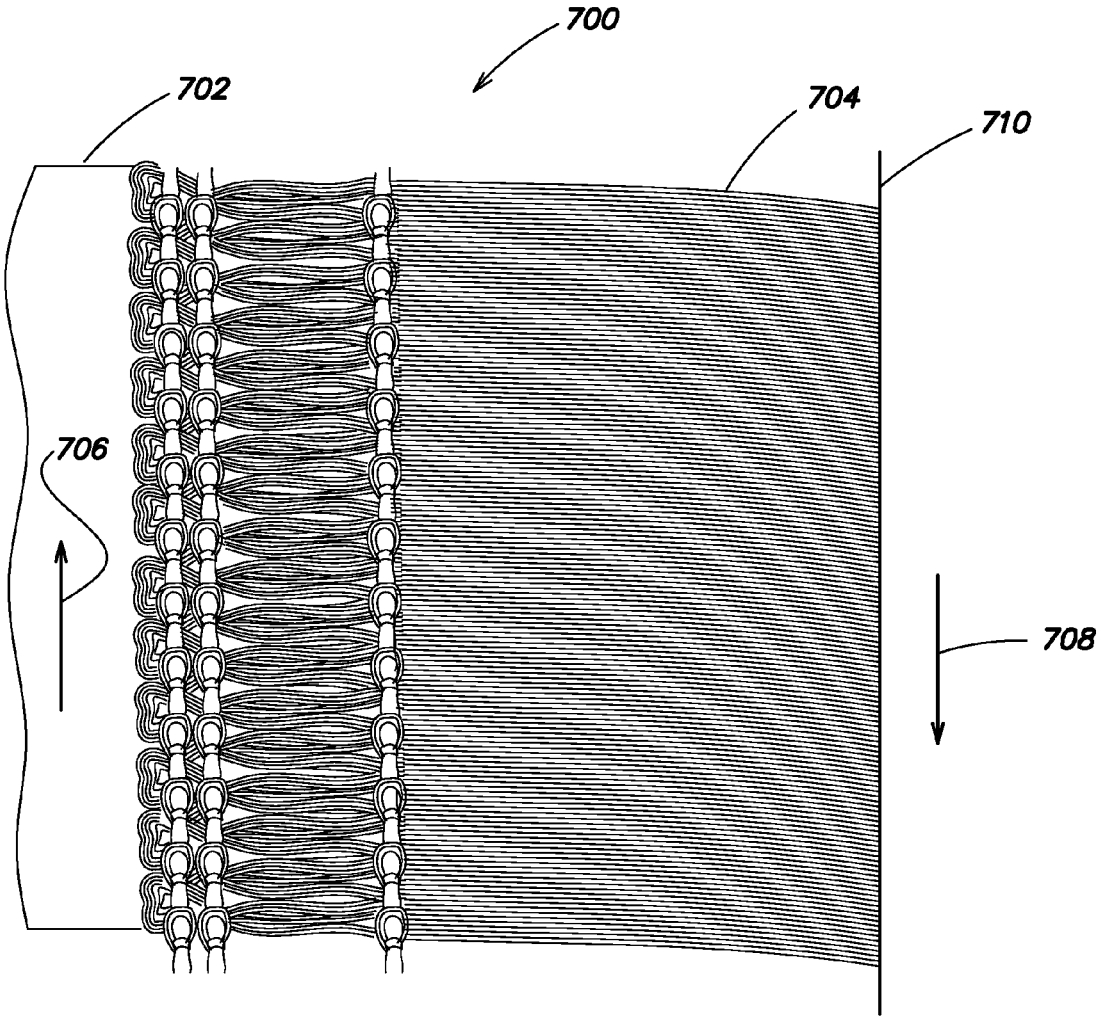
FIG. 7 illustrates an example portion of a curtain and brush edge, according to aspects of the present invention.

FIG. 4B illustrates an example embodiment of head box 1501 and example dimensions and positioning of the illustrated components, when the curtain 1501A is wound around roller tube 1503A (closed position). Shown in FIG. 7 is a cutout portion 700 of a curtain 702 and a brush edge 704. Shown in FIG. 7 is the deflection (e.g., arrow 708) of the bristles of the brush edge 704, as the curtain 702 is directed into a recessed portion (i.e., wound around a connected roller). As curtain is drawn upward in the direction of arrow 706, the bristles of the brush edge 704 deflect in the direction of arrow 708, as the bristles slide along a connected surface 710. The connected surface can include a side edge of a window frame over which the curtain is installed. In other examples, the connected surface 710 can include a portion of an optional side track configured to receive the brush edge.

The bristles of the brush edge can be constructed to bias their deflection in the plane of movement of the curtain. For example, when the curtain 702 is lowered (motion in the opposite direction of 706), bristles of brush edge 704 are configured to deflect in the direction opposite to arrow 708. According to various embodiments, responsive to the movement of the curtain, the bristles of brush edge 704 bend and sweep across the connected surface 710 maintain the connection between the curtain and the connected surface.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only, and the scope of the invention should be determined from proper construction of the appended claims, and their equivalents.

What is claimed is:

1. A curtain assembly comprising:

a curtain having a first and a second edge, wherein the curtain is selectably moveable vertically between an open position and a recessed position;

a roller attached to the curtain, wherein the roller is constructed and arranged to rotate thereby transitioning the curtain between the open position wherein the curtain is extended from the roller and the recessed position wherein the curtain is wound around the roller; and a first and a second brush edge connected to the first and the second edges of the curtain, wherein the first and second brush edges extend laterally from the first and second edge of the curtain to provide a connection to an installed surface and wherein each of the first and second brush edges comprises bristles bound into bundles, and wherein the bundles are layered into at least a first and second layer to form a brush edge biased to deflect along a plane defined by the curtain on which the brush edges are installed; and wherein each of the first and second brush edges include a flexible attachment portion, wherein the first and second brush edges and respective flexible attachment portions are constructed and arranged to wind about the roller when the curtain is transitioned to the recessed position and unwind from the roller when the curtain is transitioned to the open position.

2. The curtain assembly of claim 1, wherein the connection to the installed surface is configured to provide a light seal between the curtain and the installed surface during transition from the open position to the recessed position.

3. The curtain assembly of claim 1, wherein the first and second brush edges are configured to deflect and to maintain the connection to the installed surface during movement of the curtain.

4. The curtain assembly of claim 2, wherein the installed surface includes side edges of a window frame and the first and second brush edges respectively provide the connection to the side edges of the window frame.

5. The curtain assembly of claim 1, further comprising a first and a second side track rail configured to receive respective ones of the first and the second brush edges.

6. The curtain assembly of claim 5, wherein the first and the second side track rails are constructed and arranged to provide a channel for receiving the respective ones of the first and second brush edges.

7. The curtain assembly of claim 5, wherein the first and the second side track rails are configured to provide a respective channel for receiving the first and second brush edges, wherein the respective channels extends around the respective brush edge and around a portion of a respective edge of the curtain.

8. The curtain assembly of claim 1, wherein the roller comprises offset portions on each end of the roller, wherein the offset portions each comprise a reduced diameter portion of the each end of the roller.

9. The curtain assembly of claim 8, wherein the offset portions are configured to receive respective ones of the first and the second brush edges responsive to winding of the curtain around the roller.

10. The curtain assembly of claim 1, further comprising a roller guide configured to position the curtain proximate to a covered opening.

11. The curtain assembly of claim 10, wherein the roller guide is configured position the curtain and the first and second brush edges to be received by a first and a second side track rail configured to receive respective ones of the first and the second brush edges.

12. The curtain assembly of claim 1, further comprising at least one rail attached to the curtain, wherein the at least one rail is constructed and arranged to provide lateral stability in the curtain.

13. The curtain assembly of claim 12, wherein the at least one rail is configured to maintain the connection between the first and the second brush edges and the installed surface.

14. The curtain assembly of claim 12, wherein the at least one rail is configured to travel within a first and a second side track rail configured to receive respective ones of the first and the second brush edges.

15. The curtain assembly of claim 12, wherein the curtain includes a plurality of rail assemblies constructed and arranged to include a spacing between each of the plurality of rail assemblies, wherein the spacing is configured to minimize the overlap of each of the plurality of rail assemblies when the curtain is wound around the roller in the recessed position.

16. The curtain assembly of claim 1, wherein the roller comprises an outer roller and at least one inner roller, wherein the at least one inner roller defines an offset portion of the roller.

17. The curtain assembly of claim 16, wherein the at least one inner roller is constructed and arranged having a smaller diameter relative to the outer roller.

18. The curtain assembly of claim 17, wherein the at least one inner roller is slidably connected to the outer roller.

19. The curtain assembly of claim 18, wherein the at least one inner roller is configured to move laterally within the outer roller during rotation to maintain a positioning of a respective brush edge within the offset portion.

* * * * *